United States Patent [19]

Beer et al.

[11] 4,346,744

[45] Aug. 31, 1982

[54] WOOD WAFERIZING APPARATUS

[75] Inventors: Douglas C. Beer, Seattle, Wash.; Horst J. Jatzek, Coquitlam, Canada

[73] Assignee: CAE Machinery Ltd., Vancouver, Canada

[21] Appl. No.: 180,257

[22] Filed: Aug. 22, 1980

[51] Int. Cl.[3] ..... B27C 1/14

[52] U.S. Cl. ..... 144/176; 241/92

[58] Field of Search ..... 144/162 R, 172, 174, 144/176, 230, 218; 241/92, 274, 298

[56] References Cited

U.S. PATENT DOCUMENTS 3,991,946 11/1976 Berggren ..... 144/176

*Primary Examiner*—W. D. Bray

*Attorney, Agent, or Firm*—Townsend and Townsend

[57] ABSTRACT

A rotatable carrier element has a plurality of elongate slots opening out from a work surface thereof with cutter knives projecting from the slots for slicing wafers off pieces of wood bearing against the work surface with the sides and the grain of the pieces extending substantially parallel to the work surface and the slots when the latter pass the wood. Each cutter knife forms part of a waferizing arrangement in each slot. Each waferizing arrangement includes a reactor guide in the slot positioned relative to the knife so as to be engaged by wafers cut by the knife to break the wafers longitudinally thereof into predetermined widths.

10 Claims, 4 Drawing Figures

WOOD WAFERIZING APPARATUS

Figure 2:
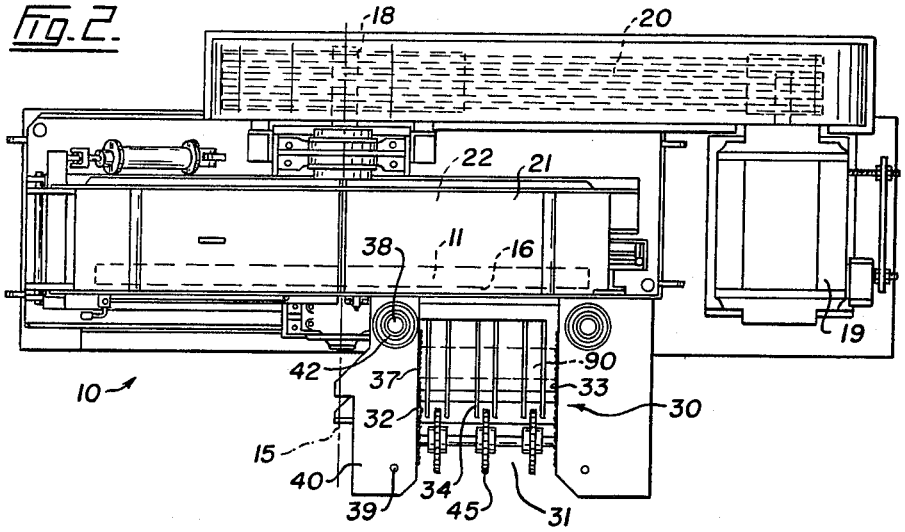

For years wafers have been cut from wood to be used in the production of waferboard. Although waferizers and wood chippers are somewhat similar in appearance, the type of product produced is quite different. Chippers cut wood mainly across the grain to produce chips used in the production of wood pulp. On the other hand, waferizers cut the wood substantially parallel to the grain to produce the wafers or flakes. These typically are something of the order of 0.025 inch thick and from 1.5 inch to 3 inches long and of random width. The thickness of the wafers is determined by the protrusion of the cutter knives used, and the length by the spacing of serrations in the knife cutting edges. The wafer board industry has used wafers of these general dimensions for many years. The recent trend, however, is to make a variance of wafer boards called "orientated strandboard". Here the wafers are aligned so that the grain generally is positioned in one direction and this gives superior properties to the resulting board. However, to align wafers that are often substantially square, in that the length and width are nearly equal, is very difficult.

The main object of the present invention is to produce in a simple and effective manner wafers particularly for use in the production of strandboard which are relative long and thin, like waferboard wafers, and of controlled or predetermined width. This is accomplished without any extra handling of the wafers which would result in the deterioration of the wafers and loss of wood for the purpose for which the wafers are intended. Strandboard wafers resulting from this invention are something of the order of three inches long, from 3/16 inch to ¾ inch wide and 0.025 inch thick. However, these dimensions can be varied as desired. With this type of wafer, it is relatively easy to align the grain thereof in one direction for the production of waferboards.

The apparatus of this invention includes a standard drum or disc carrier element having a plurality of roughly radially arranged slots therethrough with waferizer knives mounted in these slots and projecting from the working surface of this element against which pieces of wood are directed with the sides and grain thereof extending substantially parallel to the knives when the latter are slicing through the wood. The thickness of the slice of wood is determined by the amount of protrusion of the knives from the working surface, and the length of the slices is determined by serrations in the cutting edges of the knives, or the knife length itself, in the usual manner. The desirable results of this invention are attained by providing a reactor guide on the opposite side of each slot from the knife therein, and spacing this guide inwardly from the cutting edge of the knife a distance only sufficient to be engaged by slices directed against it by the knife to break these slices longitudinally thereof into wafers of substantially predetermined widths.

Apparatus in accordance with this invention comprises a rotatable carrier element having a work surface which moves when the element is rotated around an axis, spaced elongate and narrow slots through the carrier element each having an entrance opening out from said work surface and an exit opening on the opposite side of the carrier, feed means for directing longitudinal sides of pieces of wood against the work surface with said sides and the grain of the wood pieces extending substantially parallel to the slots when the latter pass the wood during movement of the carrier element, and a waferizing arrangement in each slot, each waferizing arrangement comprising a cutter knife mounted on the carrier element at one side of one of said slots and extending longitudinally thereof, said knife having a cutting edge protruding slightly through the entrance of its slot and from the work surface to cut slices of a predetermined thickness off the sides of the wood pieces bearing against the work surface, and a reactor guide on an opposite side of said slot and having a surface opposite the knife cutting edge but spaced inwardly therefrom and from the entrance of the slot a distance only sufficient to be engaged by wood slices which are directed thereagainst by the knife to break said slices longitudinally thereof into wafers substantially of a predetermined width.

Figure 1:
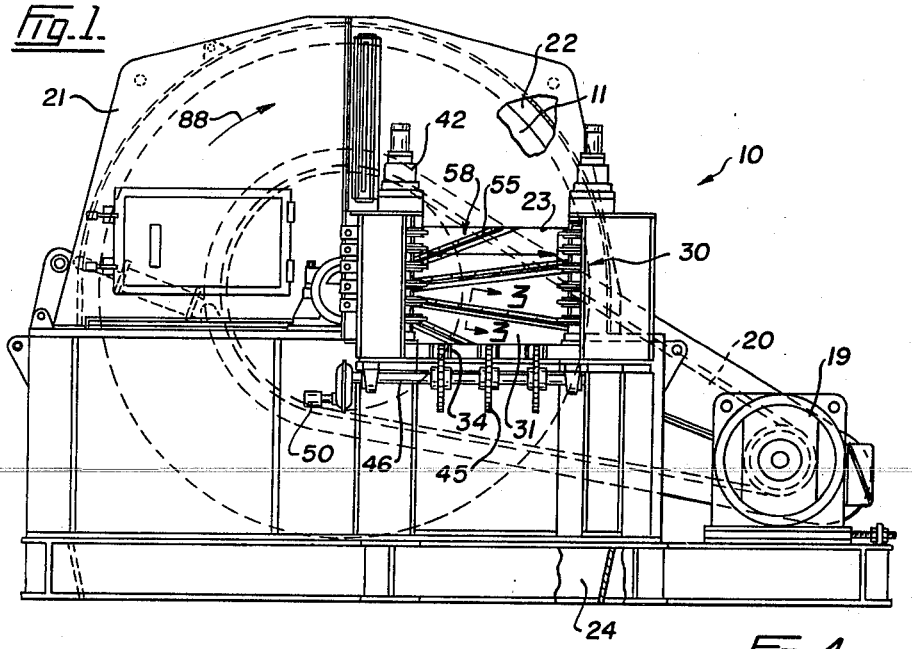
Figure 3:
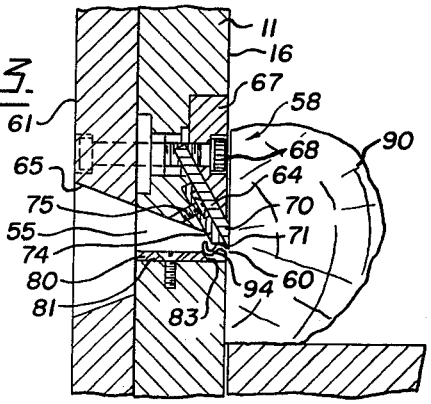
Figure 4:
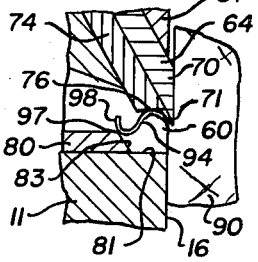

A preferred form of the invention is illustrated in the accompanying drawings, in which:

FIG. 1 is an elevation of this waferizing apparatus looking at the feed side thereof, FIG. 2 is a plan view of the apparatus of FIG. 1, FIG. 3 is an enlarged sectional view taken on the line 3—3 of FIG. 1 through a cutter knife of the apparatus, and FIG. 4 is a diagrammatic view illustrating the cutting action of this apparatus.

As stated above the present invention may be incorporated in any disc or drum waferizing apparatus, and these drawings illustrate an example of such apparatus.

Referring to the drawings, 10 is a wood waferizing apparatus which includes a carrier element or disc 11 mounted for rotation around a horizontal axis 15. The carrier has a front or work surface 16. In this example, carrier 11 is mounted on a shaft 18 which is rotated by an electric motor 19 through a drive system 20. Carrier 11 rotates within a relatively large housing 21, said housing forming a chamber 22 behind the carrier and having a feed opening 23 on the opposite side of the carrier and a outlet opening 24 below the latter.

Pieces of wood, such as small logs, cut to a length of about 24 inches to about 54 inches, are fed to the work surface 16 of carrier 11 by a feedworks generally indicated by the numeral 30. This feedworks is made up of a feed passage 31 defined by opposed moving side walls 32 and 33 and a bottom consisting of laterally spaced rails 34 which extend towards the carrier 11. The feed passage 31 extends to feed opening 23 in housing 21 to one side of the central axis 15 generally at the level of shaft 18.

Each of the side walls 32 and 33 consists of a plurality of horizontal and vertically arranged feed chains 37 which extend around sprockets mounted on inner and outer vertical shafts 38 and 39 carried by a frame 40. Each of the inner shafts is operatively connected to a suitable motor 42 mounted on frame 40. A plurality of feed sprockets 45 are mounted on a horizontal shaft 46 at the entrance end of feed passage 31, said shaft being rotated by a suitable motor 50.

Carrier 11 has a plurality of circumferentially spaced substantially radial slots 55 therethrough. There is a waferizing arrangement 58 at each slot 55, see FIGS. 1 and 3.

As all of the wafer arrangements 58 are the same, only one will now be described in detail. Each slot 55 has a narrow entrance 60 opening out from the work surface 16 of carrier 11. The slot widens towards the rear surface 61 of the carrier, as clearly shown in FIG. 3. The wafer arrangement 58 includes a cutter knife 64 which is located at one side 65 of slot 55. This knife is gripped and held in place by the standard knife clamp 67 which is held in place by a plurality of bolts 68. Knife 64 has an outer end 70 which is bevelled to form a cutting edge 71. This cutting edge protrudes slightly beyond the work surface 16 of the carrier at the entrance 60 of slot 55. The setting of the knife cutting edge relative to the carrier surface determines the thickness of the wafers being cut, this protrusion being something of the order of 0.025 inch. The cutter knife may have the usual serrations, not shown, in the cutting edge thereof, the spacing of said serrations or the length of the knife determining the length of the wafers in the usual manner.

A counterknife 74 is held in position beneath knife 64 by screws 75 and extends the length of the knife. This counterknife has an outer bevel edge 76, see FIG. 4. A reactor guide 80 is mounted on the side 81 of slot 55 opposite the side 65 thereof from which knife 64 projects. Reactor guide 80 extends the length of slot 55, and has a bevel abutting edge 83 opposite but spaced inwardly from the cutting edge 71 of the cutter knife. The edge 76 of the counterknife also is spaced inwardly from the knife edge 71, and is near and opposed to the guide edge 83. By referring to FIGS. 3 and 4 it will be seen that cutter knife 64 and counterknife 74 are inclined towards the entrance 60 of slot 55, while reactor guide 80 is substantially normal to said slot entrance and the work surface 16 of carrier 11.

When apparatus 10 is in operation, carrier 11 is rotated by motor 19 in the direction indicated by arrow 88 in FIG. 1. This causes the slots 55 of the disc to move downwardly at the feed opening 23 in housing 21. The feed chains 37 forming side walls 32 and 33 of feed passage 31 grip ends of pieces of wood 90 and move these pieces horizontally against the work surface 16 and prevents them from rotating during cutting. With this arrangement, one or more wood pieces 90 is or are pressed against the work surface of the carrier. As each cutter knife 64 moves past a piece 90, the cutting edge 71 cuts a slice 94 from the wood, see FIGS. 3 and 4. At this time, the cutting edge moves downwardly through the wood and extends substantially parallel to the grain thereof. The thickness of this slice depends upon the amount of protruberence of cutting edge 71. As the wafer slice is being cut away from the wood, it passes through slot entrance 60 and hits the bevel edge 76 of counterknife 74. This directs the slice to the bevel edge 83 of reactor guide 80 which turns the slice back towards the opposite side of the slot. This action causes the slice to break longitudinally thereof along a line indicated at 97 to form a wafer 98. It is believed that, as the wafer is initially cut, the side under tension as the wafer curls away from the knife and counterknife develops cracks on this open side. The wafer is then reversed as it hits the reactor guide and the wood fractures on the opposite or closed side thereof because of the lack of strength due to the initial cracks. This action determines the width of the wafer. The width is set by the positioning of the edge 83 of the reactor guide relative to the edge 76 of counterknife 74 and to cutting edge 71 of cutter knife 64. The angles of the bevels of edges 83 and 76 help to determine the longitudinal breaking line of each wafer and, therefore, the final width of said wafer. The position of the knife edge 71 relative to the work surface of the rotating carrier determines the thickness of each wafer, and counterknife edge 76 is set back from the cutting edge sufficiently to allow the slice to be directed towards the reactor guide. The edge 76 causes the wafer to change direction abruptly towards the edge 83 of the reactor guide which is so positioned and inclined as to swing the wafer back towards the opposite side of the disc slot, and this action causes the wafer to break away from the slice curling away from the body of the wood piece 90.

We claim:

1. Apparatus for cutting long and thin wafers of controlled width by slicing pieces of wood along the grain thereof, comprising a rotatable carrier element having a work surface which moves when the element is rotated around an axis, spaced elongate and narrow slots through the carrier element, each having an entrance opening out from said work surface, feed means for directing longitudinal sides of pieces of wood against the work surface with said sides and the grain of the wood pieces extending substantially parallel to the slots when the latter pass the wood during movement of the carrier element, and a waferizing arrangement in each slot, each waferizing arrangement comprising a cutter knife mounted on the carrier element at one side of one of said slots and extending longitudinally thereof, said knife having a cutting edge protruding slightly through the entrance of its slot and from the work surface to cut slices of a predetermined thickness off the sides of the wood pieces bearing against the work surface, and a reactor guide means on an opposite side of said slot and having a surface opposite the knife cutting edge but spaced inwardly therefrom and from the entrance of the slot a distance only sufficient to be engaged by slices which are directed thereagainst by the knife to break said slices longitudinally thereof into wafers substantially of a predetermined width.

2. Apparatus as claimed in claim 1 comprising a counterknife against the cutter knife spaced from the cutting edge thereof and opposed to the reactor guide means to bend the cut slices towards said guide.

3. Apparatus as claimed in claim 1 in which the cutter knife is mounted so as to incline forwardly in the direction of movement of the work surface of the carrier element, and the reactor guide means is mounted so as to be substantially normal to said direction of movement.

4. Apparatus as claimed in claim 2 in which the cutter knife and the counterknife are mounted so as to incline forwardly in the direction of movement of the work surface of the carrier element, and the reactor guide means is mounted so as to be substantially normal to said direction of movement.

5. Apparatus as claimed in claim 1, 2 or 3 in which said carrier element is rotatable around a central axis normal to the work surface thereof, said surface is flat, and said slots extend substantially radially relative to the central axis.

6. Apparatus for cutting long and thin wafers of controlled width by slicing pieces of wood along the grain thereof, comprising a carrier rotatable around a central axis and having a flat work surface, circumferentially spaced elongate and narrow slots through the carrier, said slots extending substantially radially of the carrier and each having an entrance opening out from the work surface, feed means for directing longitudinal sides of pieces of wood against the work surface with said sides and the grain of the wood pieces extending substantially parallel to the slots when the latter pass the wood during rotation of the carrier, and a waferizing arrangement in each slot, each waferizing arrangement comprising a cutter knife mounted on the carrier at one side of one of said slots and extending longitudinally thereof, said knife having a cutting edge protruding slightly through the entrance of its slot and from the work surface to cut slices of a predetermined thickness off the sides of the wood pieces bearing against the work surface, and a reactor guide means on an opposite side of said slot and extending longitudinally thereof and having a longitudinal abutting edge opposite the knife cutting edge but spaced inwardly therefrom and from the entrance of the slot a distance only sufficient to be engaged by slices which are directed thereagainst by the knife to break said slices longitudinally thereof into wafers substantially of a predetermined width.

7. Apparatus as claimed in claim 6 comprising a counterknife on and extending longitudinally of the cutter knife, said counterknife having a longitudinal edge spaced from the cutting edge of the cutter knife and opposed to the abutting edge of the reactor guide means and positioned to bend the cut wafers towards the abutting edge.

8. Apparatus as claimed in claim 6 in which the cutter knife is mounted so as to be inclined forwardly in the direction of rotation of the carrier disc, and the reactor guide means is mounted so as to be substantially normal to said direction of rotation.

9. Apparatus as claimed in claim 7 in which the cutter knife and the counterknife are mounted so as to incline forwardly in the direction of rotation of the carrier disc, and the reactor guide means is mounted so as to be substantially normal to said direction of rotation.

10. Apparatus as claimed in claim 9 in which the abutting edge of the reactor guide means is inclined away from the slot entrance, and said longitudinal edge of the counter-knife is inclined towards said abutting edge.

* * * * *